US008079824B2

(12) United States Patent
Chou

(10) Patent No.: US 8,079,824 B2
(45) Date of Patent: Dec. 20, 2011

(54) AIR COMPRESSING ASSEMBLY

(76) Inventor: Wen San Chou, Tainan Hsien (TW)

( * ) Notice: Subject to any disclaimer, the term of this patent is extended or adjusted under 35 U.S.C. 154(b) by 663 days.

(21) Appl. No.: 12/290,800

(22) Filed: Nov. 4, 2008

(65) Prior Publication Data

US 2010/0111724 A1 May 6, 2010

(51) Int. Cl.
*F04B 41/06* (2006.01)

(52) U.S. Cl. ..... 417/7; 417/16; 417/85; 417/234

(58) Field of Classification Search ..... 417/2, 3, 417/4, 5, 7, 16, 85, 234
See application file for complete search history.

(56) References Cited

U.S. PATENT DOCUMENTS 3,797,245 A * 3/1974 Hein ..... 60/452
4,244,678 A * 1/1981 Uehara et al. ..... 417/218
5,888,054 A * 3/1999 Djordjevic ..... 417/254
6,295,693 B1 10/2001 Chou ..... 15/330
6,413,056 B1 7/2002 Chou ..... 417/366
6,846,162 B2 1/2005 Chou ..... 417/63
7,240,642 B2 7/2007 Chou ..... 123/41.35
2011/0038737 A1* 2/2011 Conry et al. ..... 417/53

* cited by examiner

*Primary Examiner* — Peter Macchiarolo
(74) *Attorney, Agent, or Firm* — Charles E. Baxley

(57) ABSTRACT

An air compressing assembly includes an air tank disposed in a receptacle, an air blowing device disposed in the receptacle and coupled to the air tank for generating and supplying a pressurized air of a relatively lower air pressure and greater flowing quantity to the air tank, an air compressing device disposed in the receptacle for generating and supplying another pressurized air of a relatively greater air pressure and a relatively decreased flowing quantity to the air tank, and a control device coupled to the air compressing devices for controlling the air compressing devices to generate and supply different pressurized airs of different pressures and different flowing quantities to inflate different air facilities.

20 Claims, 6 Drawing Sheets

AIR COMPRESSING ASSEMBLY

BACKGROUND OF THE INVENTION

1. Field of the Invention

The present invention relates to an air compressing assembly, and more particularly to an air compressing assembly including two different air compressing devices or compressors for generating and supplying two air flows of different pressures and different flowing quantities and for inflating different air facilities.

2. Description of the Prior Art

Typical air compressing devices comprise a fan device rotatably received in a compressor housing, and a motor coupled to the fan device for driving or rotating the fan device to generate and supply a pressurized air and to inflate various air facilities, such as tires, air beds, air cushions, hovercrafts, etc.

For example, U.S. Pat. No. 6,295,693 to Chou, and U.S. Pat. No. 6,413,056 to Chou disclose two of the typical air compressing devices each comprising a centrifugal type fan device coupled to a motor and rotated or driven by the motor for air circulating or paddling or pressurizing purposes or for air drawing or vacuuming purposes.

However, the motorized centrifugal type fan devices may only be used to generate and supply a pressurized air of a lower air pressure and a greater flowing quantity, such that the typical centrifugal type fan devices may only be used to inflate the air beds, the air cushions, the hovercrafts or the like, but may not be used to inflate the vehicle tires.

U.S. Pat. No. 6,846,162 to Chou, and U.S. Pat. No. 7,240,642 to Chou disclose two further typical air compressing devices each comprising a piston slidably received in a cylinder housing, and a motor coupled to the piston for moving the piston relative to the cylinder housing in a reciprocating action, in order to generate a pressurized air of a greater air pressure and a decreased flowing quantity.

However, the pressurized air of a greater air pressure and a decreased flowing quantity is suitable for inflating the vehicle tires only, but may not be used to inflate the other air facilities, such as the air beds, the air cushions, the hovercrafts, etc., because it may take a long time to inflate a single air bed, a single air cushion, or a single hovercraft.

The present invention has arisen to mitigate and/or obviate the afore-described disadvantages of the conventional air compressing assemblies.

SUMMARY OF THE INVENTION

The primary objective of the present invention is to provide an air compressing assembly including two different air compressing devices or compressors for generating and supplying two air flows of different pressures and different flowing quantities and for inflating different air facilities.

In accordance with one aspect of the invention, there is provided an air compressing assembly comprising a receptacle including a chamber formed therein, an air tank disposed in the chamber of the receptacle, and including an outlet port, a first air compressing device including an air blowing device disposed in the chamber of the receptacle and coupled to the air tank for generating and supplying a first pressurized air of a relatively lower air pressure and a relatively greater flowing quantity to the air tank, a second air compressing device disposed in the chamber of the receptacle and coupled to the air tank for generating and supplying a second pressurized air of a relatively greater air pressure and a relatively decreased flowing quantity to the air tank, and a control device coupled to the first and the second air compressing devices for controlling the first and the second air compressing devices to selectively generate and supply the first and the second pressurized airs to the air tank.

The air blowing device includes an outlet coupled to an inlet port of the air tank. The receptacle includes an opening formed therein, the air blowing device includes an inlet aligned with the opening of the receptacle.

The receptacle includes another opening formed therein and aligned with the outlet port of the air tank. The air blowing device includes a motor attached and secured and coupled to the air blowing device for driving the air blowing device to generate and supply the first pressurized air.

The second air compressing device includes a cylinder housing, a piston slidably engaged in the cylinder housing and having a piston rod extended from the piston for allowing the piston and the piston rod to be moved relative to the cylinder housing in a reciprocating action.

The second air compressing device includes a support plate attached and secured to the cylinder housing, and a motor attached and secured to the support plate and coupled to the piston rod for moving the piston rod and the piston to move relative to the cylinder housing.

The second air compressing device includes a gear rotatably attached to the support plate with an axle, a pole coupled to the piston rod and offset from the axle, and the motor includes a pinion meshed and engaged with the gear for driving and rotating the gear to operate the piston rod with the pole.

The cylinder housing includes an exit coupled to an inlet port of the air tank. The exit of the cylinder housing is coupled to a first coupler for coupling to the air tank.

The cylinder housing includes a bracket attached the exit and coupled to the first coupler with a securing device. The second air compressing device includes a retaining member securing the first coupler to the inlet port of the air tank.

The first coupler is coupled to the inlet port of the air tank with a tube and two second couplers. The second air compressing device includes a retaining member securing the first coupler to the second coupler.

A pressure gauge may further be provided and coupled to the air tank for detecting an air pressure in the air tank. The pressure gauge is attached and secured to the air blowing device and engaged in the opening of the receptacle for being viewed by users.

A power supply device may further be provided and includes a casing attached to the receptacle, and a battery disposed in the casing for supplying an electric energy to the first and the second air compressing devices and the control device. The power supply device includes a plug provided on the casing and electrically coupled to the battery.

A strap may further be provided and includes two pins engaged with the casing for attaching and coupling the strap to the casing and for carrying the casing. The receptacle includes at least one retainer provided thereon for engaging with the strap and for stably coupling the strap to the casing and the receptacle.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
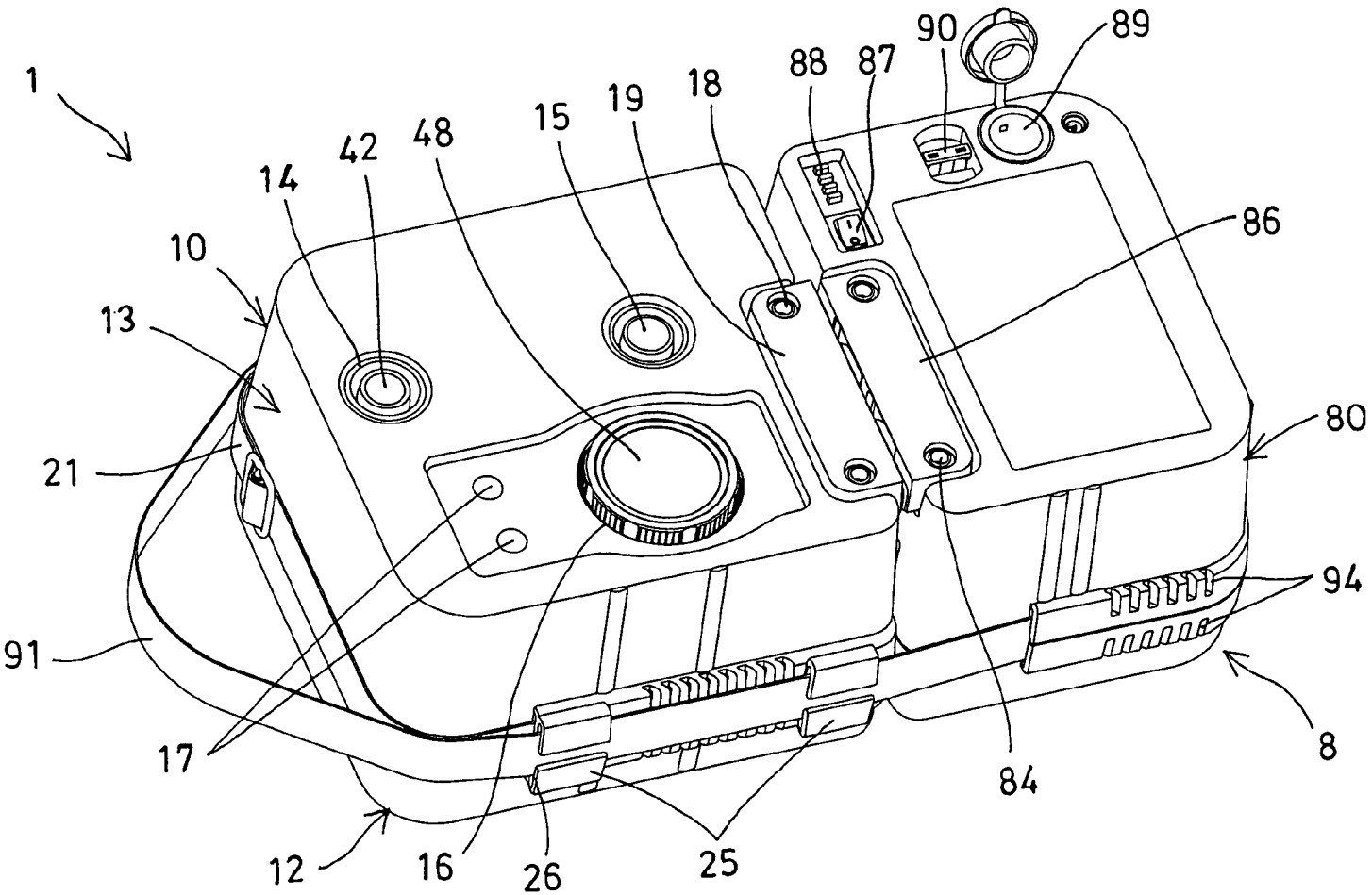
FIG. 1 is a perspective view of an air compressing assembly in accordance with the present invention.

Referring to the drawings, and initially to FIGS. 1-5, an air compressing assembly 1 in accordance with the present invention comprises an outer receptacle 10 including a chamber 11 formed therein and formed or defined by a lower receptacle member 12 and an upper receptacle member 13, in which the upper receptacle member 13 includes three openings 14, 15, 16 formed therein, two switch buttons 17 formed or provided thereon, two terminals 18 provided thereon, and a cap 19 attached and secured onto the upper receptacle member 13 of the receptacle 10 for covering or shielding or protecting the terminals 18. A carrier plate 20 is disposed and secured in the chamber 11 of the receptacle 10. A strap 21 includes two pins 22 (FIG. 3) attached to two ends and engaged with two studs 23 that are provided in the receptacle 10 for attaching or coupling the strap 21 to the receptacle 10 and for carrying the receptacle 10.

Figure 4:
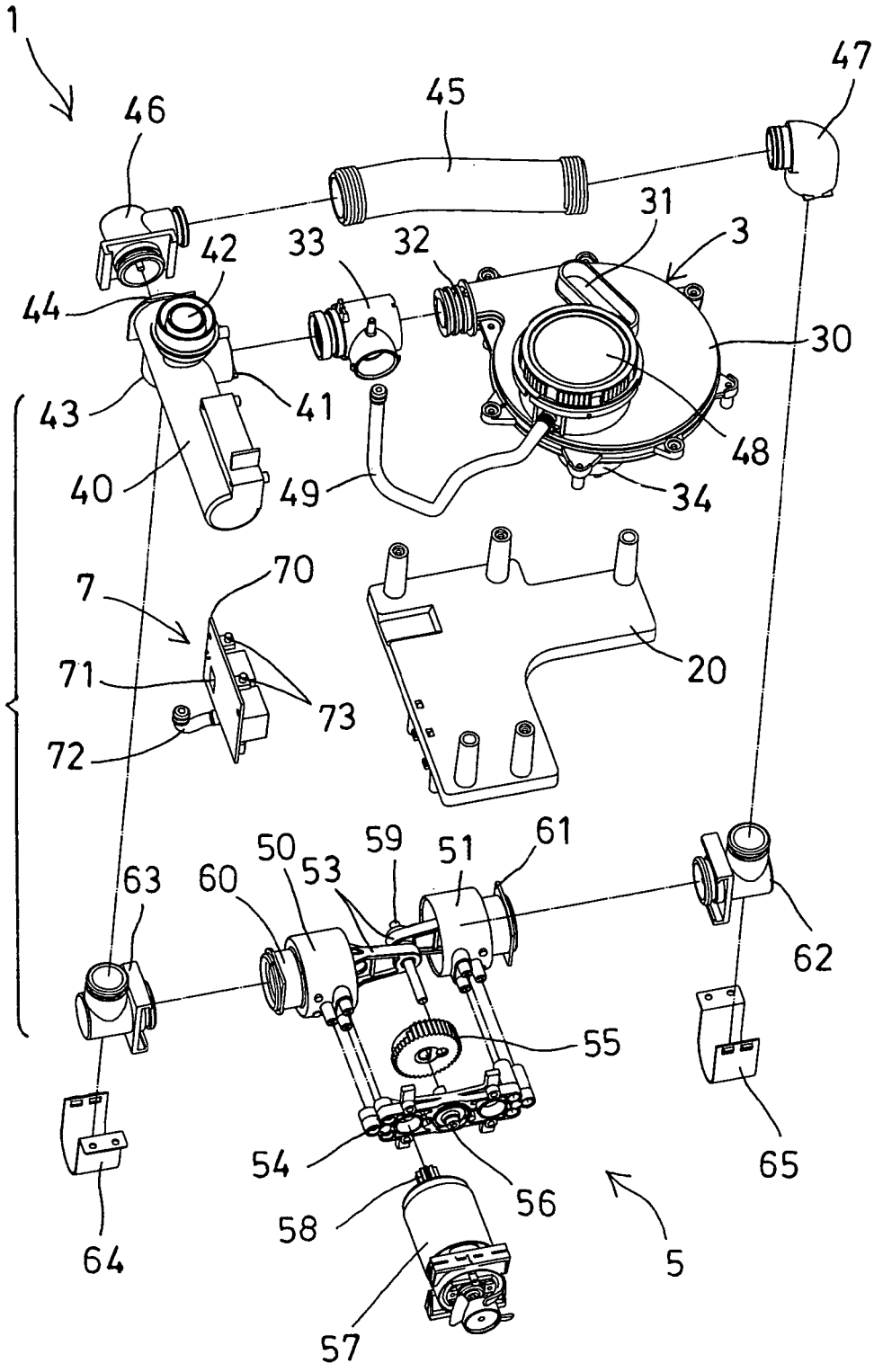
FIG. 4 is another partial exploded view of the air compressing assembly.
Figure 5:
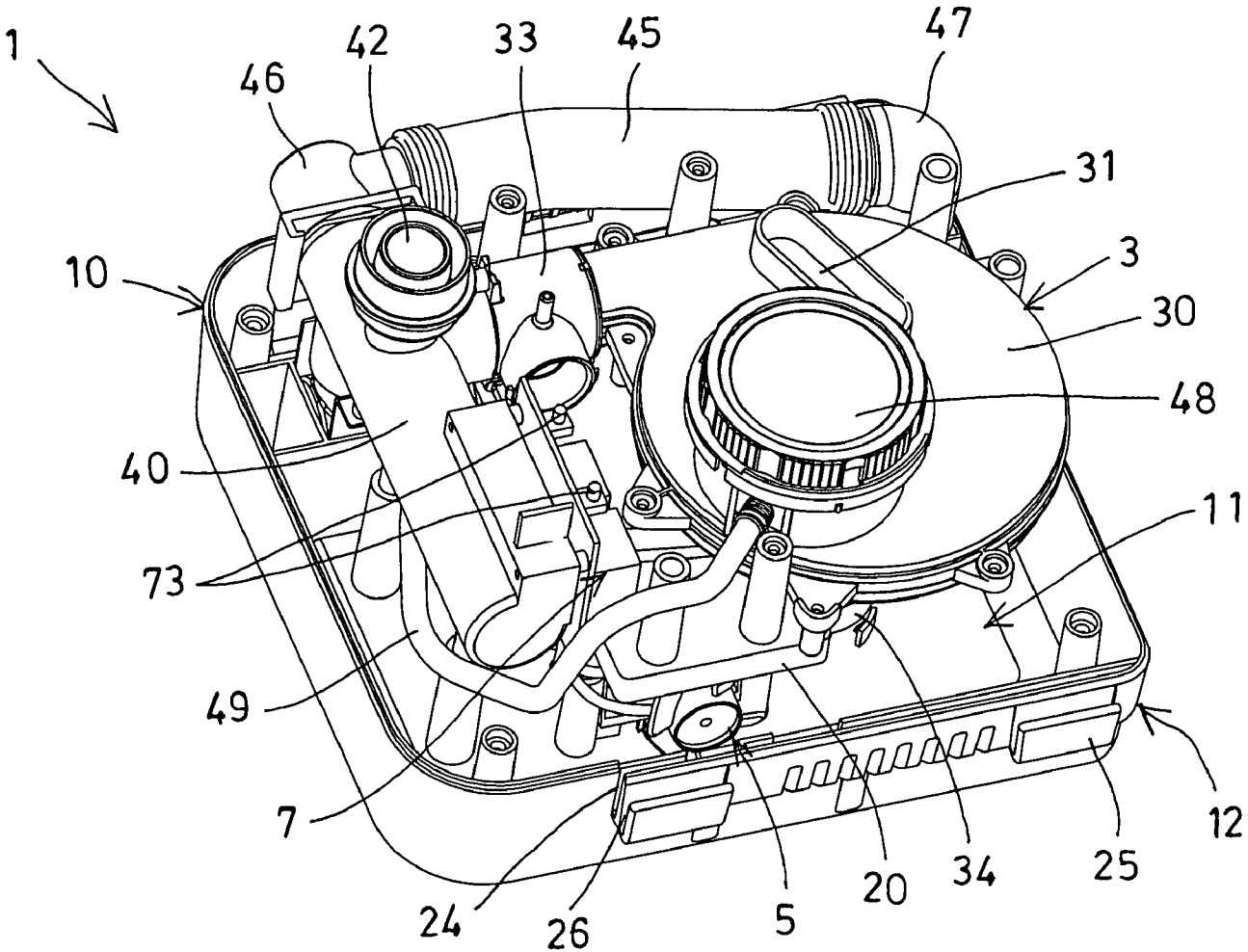
FIG. 5 is a partial upper perspective view of the air compressing assembly, in which a portion of the air compressing assembly has been removed for illustrating the inner structure of the air compressing assembly.
Figure 6:
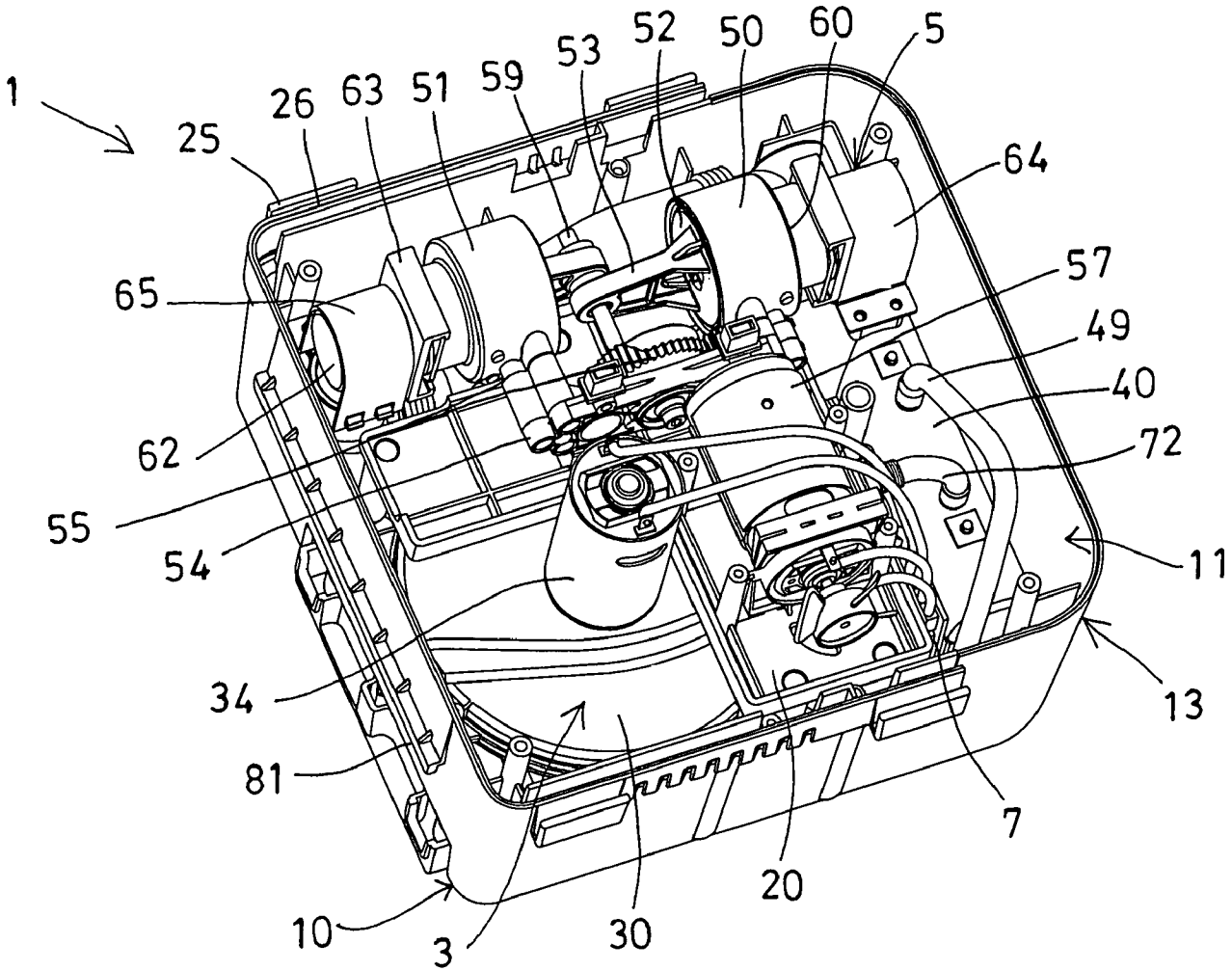
FIG. 6 is a partial bottom perspective view of the air compressing assembly, in which a portion of the air compressing assembly has been removed for illustrating the inner structure of the air compressing assembly.

A first air compressing device 3 comprises a fan device or air blower or air blowing device 30 attached and secured onto the carrier plate 20 and disposed and secured in the chamber 11 of the receptacle 10 and including an inlet 31 aligned with one of the openings 15 of the receptacle 10 for allowing the air in the outer environment to be drawn into the air blowing device 30, and including an outlet 32 coupled to a coupler 33 which is then coupled to an inlet port 41 of an air tank 40 for supplying the pressurized air into the air tank 40 that is disposed and secured in the chamber 11 of the receptacle 10. As shown in FIGS. 4-6, a motor 34 is attached and secured to the air blowing device 30 and coupled to the air blowing device 30 for driving or rotating the air blowing device 30 to generate and supply the pressurized air of a relatively lower air pressure and a relatively greater flowing quantity to the air tank 40. Two examples of the air blowing devices 30 have been disclosed in U.S. Pat. No. 6,295,693 to Chou, and U.S. Pat. No. 6,413,056 to Chou which may be taken as the references for the present invention.

As shown in FIGS. 1 and 3-5, the air tank 40 includes an outlet port 42 aligned with the other opening 14 of the receptacle 10 for coupling to various air facilities (not shown), such as tires, air beds, air cushions, hovercrafts, etc. with hoses or pipes (not shown), and includes one or more (such as two) further inlet ports 43, 44 for coupling to a second air compressing device 5, for example, one of the inlet ports 44 of the air tank 40 may be coupled to the second air compressing device 5 with a tube 45 and two couplers 46, 47. A pressure gauge 48 may be attached and secured to the air blowing device 30 and coupled to the air tank 40 with a hose 49 for detecting and displaying or indicating the air pressure in the air tank 40, the pressure gauge 48 may be engaged in the other opening 16 of the receptacle 10 (FIG. 1) for being viewed by the users.

As shown in FIGS. 4-6, the second air compressing device 5 includes one or more (such as two) cylinder housings 50, 51 attached and secured to the carrier plate 20, and includes a piston 52 (FIG. 6) slidably engaged in each of the cylinder housings 50, 51, and includes a piston rod 53 attached or secured to or extended from each of the pistons 52. A support plate 54 is attached and secured to the cylinder housings 50, 51, a gear 55 is rotatably attached to the support plate 54 with an axle 56, another motor 57 is attached and secured to the support plate 54 and includes a pinion 58 attached to the spindle (not shown) of the motor 57 and meshed or engaged with the gear 55 for driving or rotating the gear 55. A pole 59 is coupled to the piston rods 53 and eccentrically coupled to the gear 55 and offset from the axle 56 for allowing the piston rods 53 and the pistons 52 to be driven or moved relative to the cylinder housings 50, 51 in a reciprocating action by the motor 57.

The cylinder housings 50, 51 each include an exit 60 having a square-shaped bracket 61 attached and secured thereto for coupling to another coupler 62 with a locking or securing device 63, and one of the couplers 62 is directly coupled to the inlet port 43 of the air tank 40, and the other coupler 62 is then coupled to the other inlet port 44 of the air tank 40 with the tube 45 and the couplers 46, 47 for allowing the pressurized air of a relatively greater air pressure and a relatively decreased flowing quantity generated by the second air compressing device 5 to be supplied into the air tank 40. Two brackets or retaining members 64, 65 may be used to solidly secure the couplers 62 to the inlet port 43 of the air tank 40 and to the coupler 47 respectively.

A control device 7 includes a circuit board 70 attached and secured onto the carrier plate 20 and electrically coupled to the terminals 18 of the receptacle 10, and includes an integrated circuit or central processing unit or processor device 71 attached and secured to the circuit board 70 and electrically coupled to the motors 34, 57 of the air compressing devices 3, 5 respectively for controlling or actuating or operating the motors 34, 57, and includes a connecting pipe 72 coupled to the air tank 40 for detecting the air pressure in the air tank 40 and for controlling the energizing or operation of the motors 34, 57, and includes two switches 73 aligned with the switch buttons 17 of the receptacle 10 for being selectively depressed or actuated by the users in order to control or operate the motors 34, 57.

A power supply device 8 includes a casing 80 formed by two casing members and detachably attached and secured to the receptacle 10 with another latching or locking or securing device 81, and includes a battery 82 disposed and secured in the casing 80 and having two poles 83 electrically coupled to two terminals 84 of the casing 80 which are then electrically coupled to the terminals 18 of the receptacle 10 with two conductors 85 for supplying the electric energy to the motors 34, 57 and/or the control device 7. Another cap 86 is attached and secured onto the casing 80 for covering or shielding or protecting the terminals 84 and/or the conductors 85. A control switch 87 is provided on the casing 80 and electrically coupled to the terminals 84 and/or the poles 83 for controlling the supplying of the electric energy to the motors 34, 57 and/or the control device 7 from the battery 82.

One or more light members 88 are provided on the casing 80 and electrically coupled to the terminals 84 and/or the poles 83 for generating lights to indicate or to show the electric energy stored or remained in the battery 82. A plug 89 is provided on the casing 80 and electrically coupled to the poles 83 of the battery 82 for electrically coupling to the other electric power supply devices (not shown), such as the cigarette lighters for the vehicles or the like and for supplying the electric energy to selectively charge the battery 82. The power supply device 8 further includes a fuse 90 coupled between the battery 82 and the plug 89 for preventing the battery 82 from being over charged.

Figure 3:
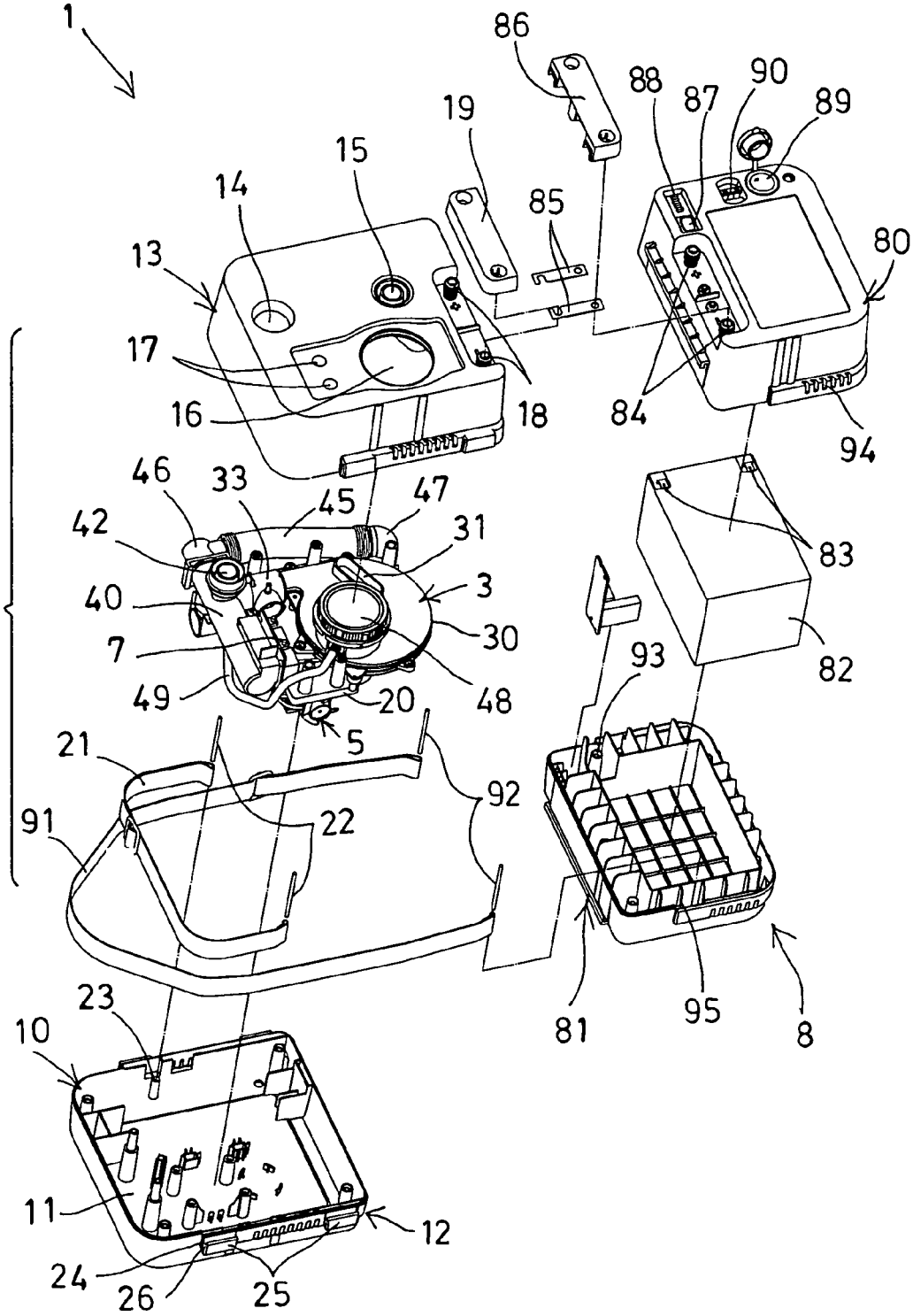
FIG. 3 is a partial exploded view of the air compressing assembly.

Another strap 91 may further be provided and includes two pins 92 (FIG. 3) attached to two ends and engaged with two studs 93 that are provided in the casing 80 for attaching or coupling the strap 91 to the casing 80 and for carrying the casing 80 and the battery 82, and the casing 80 may include one or more pairs of L-shaped retainers 94 provided thereon or extended therefrom for forming one or more channels 95 in the casing 80 and for receiving or for engaging with the strap 91. As shown in FIGS. 3 and 5, the receptacle 10 may include one or more slots 24 formed therein for receiving or for engaging with the strap 21, and may include one or more pairs of L-shaped retainers 25 provided thereon or extended therefrom for forming one or more grooves 26 in the receptacle 10 and for receiving or for engaging with the strap 91.

Figure 2:
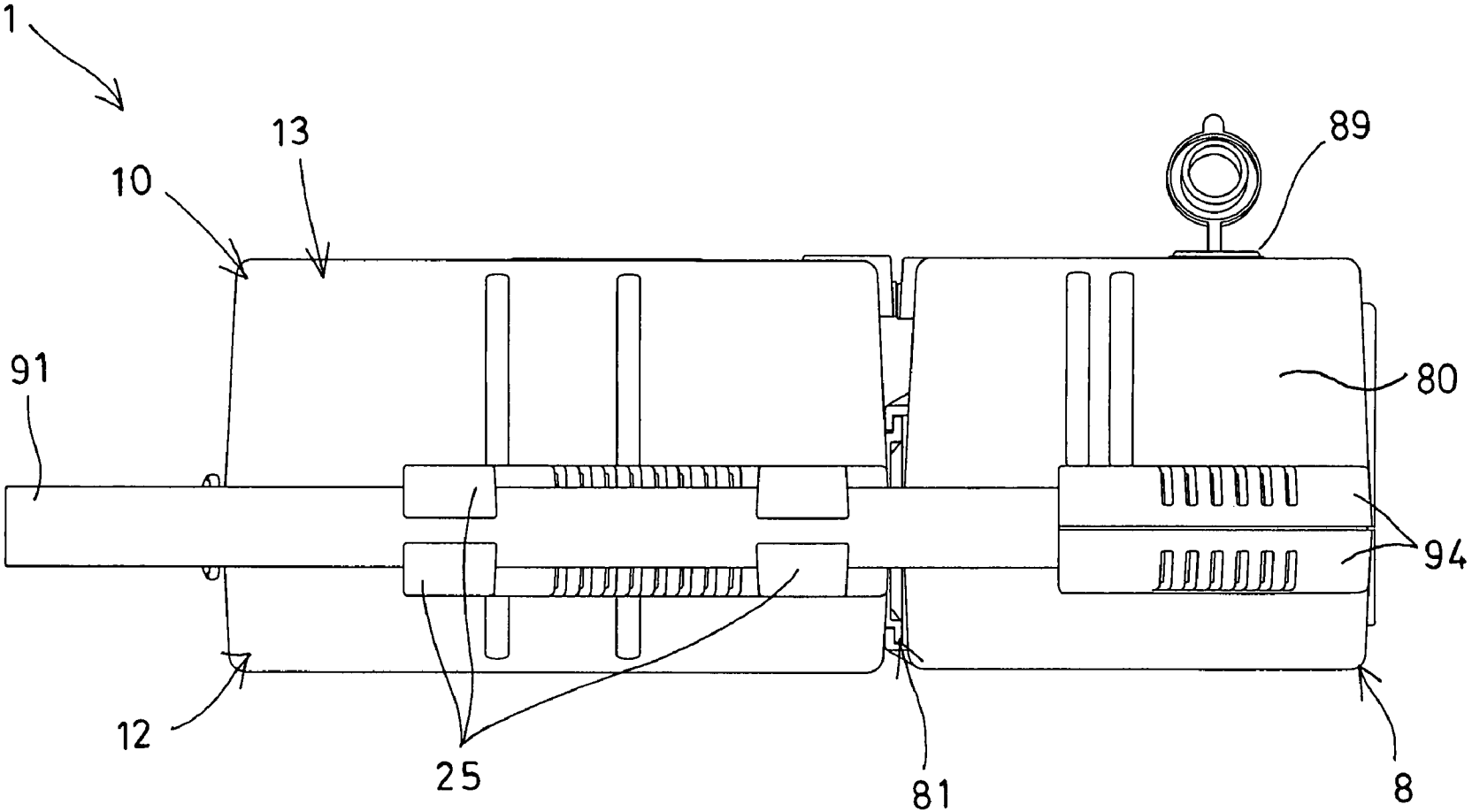
FIG. 2 is a side plan schematic view of the air compressing assembly.

In operation, as shown in FIGS. 1 and 2, the casing 80 may be detachably attached and secured to the receptacle 10 with the latching or locking or securing device 81 and/or the strap 91, for allowing the casing 80 and the receptacle 10 to be stably carried by the users with the strap 91. The receptacle 10 may alternatively be carried by the users with the other strap 21 particularly when the casing 80 is detached and disengaged from the receptacle 10. The switches 73 and/or the switch buttons 17 of the receptacle 10 may be selectively depressed or actuated by the users in order to control or operate the motors 34, 57 with the control device 7.

It is preferable that the motor 34 is first actuated or operated to drive or rotate the air blowing device 30 to generate and supply the pressurized air of a relatively lower air pressure and a relatively greater flowing quantity to the air tank 40 when it is required to inflate various air facilities, such as tires, air beds, air cushions, hovercrafts, etc. When the control device 7 has detected that the air pressure in the air tank 40 reaches a predetermined value, the control device 7 may switch and actuate or operate the other motor 57 to actuate the piston rods 53 and the pistons 52 of the second air compressing device 5 to generate the pressurized air of a greater air pressure and a decreased flowing quantity and to supply the pressurized air into the air tank 40 and to allow the air facilities to be easily and quickly or suitably inflated. The inlet 31 of the air blowing device 30 and/or the openings 15 of the receptacle 10 may be coupled to the other air facilities, such as tires, air beds, air cushions, hovercrafts, etc. for drawing or vacuuming the other air facilities, when required.

Accordingly, the air compressing assembly includes two different air compressing devices or compressors for generating and supplying two air flows of different pressures and different flowing quantities and for inflating different air facilities.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air compressing assembly comprising:

a receptacle including a chamber formed therein, an air tank disposed in said chamber of said receptacle, and including an outlet port, a first air compressing device including an air blowing device disposed in said chamber of said receptacle and coupled to said air tank for generating and supplying a first pressurized air of a relatively lower air pressure and a relatively greater flowing quantity to said air tank, a second air compressing device disposed in said chamber of said receptacle and coupled to said air tank for generating and supplying a second pressurized air of a relatively greater air pressure and a relatively decreased flowing quantity to said air tank, and a control device coupled to said first and said second air compressing devices for controlling said first and said second air compressing devices to selectively generate and supply said first and said second pressurized airs to said air tank.

2. The air compressing assembly as claimed in claim 1, wherein said air blowing device includes an outlet coupled to an inlet port of said air tank.

3. The air compressing assembly as claimed in claim 1, wherein said receptacle includes an opening formed therein, said air blowing device includes an inlet aligned with said opening of said receptacle.

4. The air compressing assembly as claimed in claim 1, wherein said receptacle includes an opening formed therein and aligned with said outlet port of said air tank.

5. The air compressing assembly as claimed in claim 1, wherein said air blowing device includes a motor attached and secured and coupled to said air blowing device for driving said air blowing device to generate and supply said first pressurized air.

6. The air compressing assembly as claimed in claim 1, wherein said second air compressing device includes a cylinder housing, a piston slidably engaged in said cylinder housing and having a piston rod extended from said piston for allowing said piston and said piston rod to be moved relative to said cylinder housing in a reciprocating action.

7. The air compressing assembly as claimed in claim 6, wherein said second air compressing device includes a support plate attached and secured to said cylinder housing, and a motor attached and secured to said support plate and coupled to said piston rod for moving said piston rod and said piston to move relative to said cylinder housing.

8. The air compressing assembly as claimed in claim 7, wherein said second air compressing device includes a gear rotatably attached to said support plate with an axle, a pole coupled to said piston rod and offset from said axle, and said motor includes a pinion meshed and engaged with said gear for driving and rotating said gear to operate said piston rod with said pole.

9. The air compressing assembly as claimed in claim 6, wherein said cylinder housing includes an exit coupled to an inlet port of said air tank.

10. The air compressing assembly as claimed in claim 9, wherein said exit of said cylinder housing is coupled to a first coupler for coupling to said air tank.

11. The air compressing assembly as claimed in claim 10, wherein said cylinder housing includes a bracket attached said exit and coupled to said first coupler with a securing device.

12. The air compressing assembly as claimed in claim 11, wherein said second air compressing device includes a retaining member securing said first coupler to said inlet port of said air tank.

13. The air compressing assembly as claimed in claim 10, wherein said first coupler is coupled to said inlet port of said air tank with a tube and two second couplers.

14. The air compressing assembly as claimed in claim 13, wherein said second air compressing device includes a retaining member securing said first coupler to said second coupler.

15. The air compressing assembly as claimed in claim 1, wherein said second air compressing device includes two cylinder housings, a piston slidably engaged in each of said cylinder housings and having a piston rod extended from said piston for allowing said pistons and said piston rods to be moved relative to said cylinder housings in a reciprocating action, a pole coupled to said piston rods, and a motor coupled to said pole for moving said pistons to move relative to said cylinder housings in the reciprocating action.

16. The air compressing assembly as claimed in claim 1, wherein a pressure gauge is coupled to said air tank for detecting an air pressure in said air tank.

17. The air compressing assembly as claimed in claim 1, wherein a power supply device includes a casing attached to said receptacle, and a battery disposed in said casing for supplying an electric energy to said first and said second air compressing devices and said control device.

18. The air compressing assembly as claimed in claim 17, wherein said power supply device includes a plug provided on said casing and electrically coupled to said battery.

19. The air compressing assembly as claimed in claim 17, wherein a strap includes two pins engaged with said casing for attaching and coupling said strap to said casing and for carrying said casing.

20. The air compressing assembly as claimed in claim 19, wherein said receptacle includes at least one retainer provided thereon for engaging with said strap.

* * * * *